United States Patent [19]

Suominen

[11] 4,241,561

[45] Dec. 30, 1980

[54] BAG SUPPORT AND DISPENSING APPARATUS

[76] Inventor: Heikki S. Suominen, 33730 Tampere 73, Finland

[21] Appl. No.: 27,534

[22] Filed: Apr. 5, 1979

[30] Foreign Application Priority Data

Apr. 18, 1978 [FI] Finland ..... 781164

[51] Int. Cl.[3] ..... B65B 67/04

[52] U.S. Cl. ..... 53/390; 53/572; 53/384

[58] Field of Search ..... 53/390, 384, 385, 386, 53/571, 572, 573

[56] References Cited

U.S. PATENT DOCUMENTS

| | | | |
|---|---|---|---|
| 2,843,988 | 7/1958 | Thompson et al. | 53/572 X |
| 3,161,212 | 12/1964 | White | 53/572 X |

FOREIGN PATENT DOCUMENTS

| | | | |
|---|---|---|---|
| 1394746 | 5/1975 | United Kingdom | 53/385 |

*Primary Examiner*—Travis S. McGehee

*Attorney, Agent, or Firm*—Pollock, Vande Sande & Priddy

[57] ABSTRACT

A bag support and dispensing apparatus including a sleeve that is passed through aligned apertures in a stack of bags to support the bags. A collar at the back end of the sleeve is detachably engaged with a support member. The forward end of the sleeve has a flange that is dimensioned to readily pass through an enlarged aperture in the top portion of the front wall of a bag when the front wall of the bag is pulled in a forward direction. The flange is also dimensioned to resist passing through a smaller aperture in the top portion of the back wall of the bag to allow the bag to be held in an open position for receiving articles. A loaded bag is disengaged from the sleeve by pulling the bag in a forward direction with sufficient force to distend the smaller rear aperture so that the flange passes through the smaller aperture to release the back wall of the loaded bag. The sleeve is disengaged from the support member after all of the bags have been removed and thereafter a new stack of bags is slipped over the sleeve and the sleeve is re-engaged with the support member.

2 Claims, 8 Drawing Figures

FIG 5
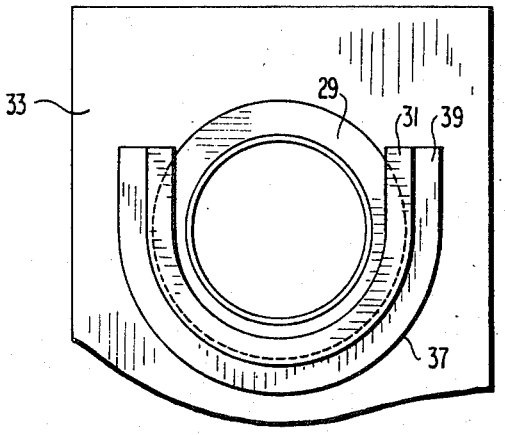
FIG 6
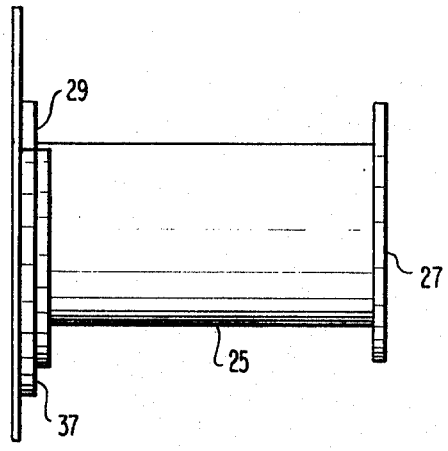
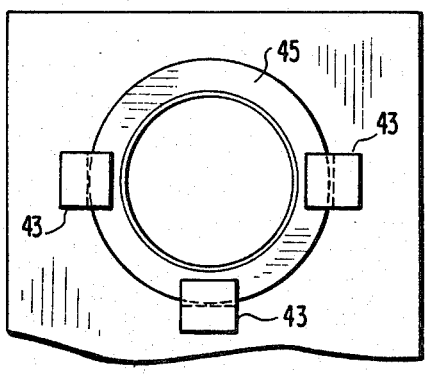
FIG 7
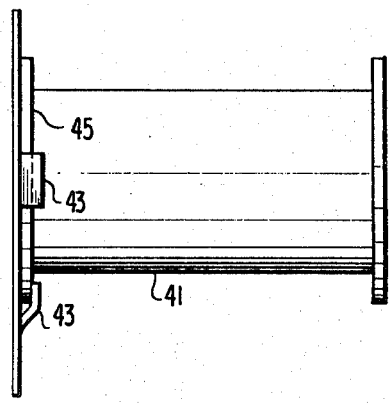
FIG 8

BAG SUPPORT AND DISPENSING APPARATUS

DESCRIPTION

TECHNICAL FIELD

The invention relates to a plastic bag support and dispensing apparatus, and, more particularly, to such an apparatus that detachably supports a sleeve that is used to retain and dispense a stack of bags.

BACKGROUND ART

In the U.S. patents to Suominen, U.S. Pat. No. 3,858,382 and No. 3,973,376, there is disclosed a bag support apparatus including a shaft that passes through aligned apertures in a plurality of stacked plastic bags. The top portion of the front wall of each bag has an aperture that is sufficiently large to easily pass an enlarged flange that is affixed to the free end of the shaft. Thus, when the front edge of a bag is pulled outwardly, the flange passes through the large aperture in the front wall and a corresponding smaller aligned aperture in the rear wall catches on the flange so that the bag may be held in an open position to easily receive articles. After the bag is loaded, the bag is pulled in a forward direction with sufficient force to distend the smaller rear aperture so that the flange is passed through the rear aperture, and the bag is disengaged from the sleeve.

The bag support apparatus of the prior art tends to be somewhat complicated in construction, thereby resulting in higher manufacturing costs. In addition, the prior art apparatus has the added disadvantage that when a stack of bags is removed from the supporting sleeve, it is not particularly easy or convenient to place a new stack of bags in supporting engagement with the sleeve. Accordingly, it is a primary object of the invention to provide a simple, relatively inexpensive and effective means for supporting a stack of bags for easy loading and for quickly and efficiently applying a new stack of bags after the bags in the previous stack have been used.

DISCLOSURE OF INVENTION

In order to achieve the objects of the invention and to overcome the problems of the prior art, the apparatus for supporting and dispensing bags includes a bag support sleeve that passes through aligned apertures in a stack of plastic bags. The sleeve has a flange formed on its front end.

In a preferred embodiment of the invention, the back end of the sleeve has an inner collar that engages a shaft portion of a support member when the sleeve is pressed downwardly and inwardly onto the support member. When the inner collar is engaged with the support member, an extending top edge of the support member abuts a portion of the inside wall of the sleeve to maintain the sleeve in firm contact with the support member.

A bag is placed in a loading position by pulling outwardly on the front edge of the bag so that the flange is passed through a large aperture in the front wall of the bag and the front wall is thereby disengaged from the flange. As the bag is pulled forward, a smaller aligned aperture in the rear wall of the bag catches on the flange and the bag is thereby held in an open position to receive articles. After the bag is loaded, the bag is pulled in a forward direction with sufficient force to distend the smaller rear aperture so that the rear wall may be disengaged from the flange.

After all of the bags on a sleeve have been removed, the sleeve may be disengaged from the support member by pulling upwardly and outwardly on the sleeve. Thereafter, the sleeve may be passed through the aligned apertures of a new stack of bags and may then be engaged with the support member. Alternatively, when the bags on a sleeve are all removed, the sleeve may be detached from the support member and discarded and a new stack having an associated engaged sleeve may be snapped onto the support member.

A further embodiment of the invention includes a radially extending lip that is affixed to the back end of the sleeve. The extending lip is pushed downwardly to slide into a U-shaped slot of a U-bracket that supports the sleeve and the associated stack of bags. The sleeve may be removed by pulling upwardly to release the lip from the confines of the slot.

Another embodiment of the invention includes a plurality of bracket tongues that form slots that are engaged by a radially extending lip on the back end of the sleeve when the sleeve is moved in a downward direction to place outer edges of the tongues in overlapping relation with the lip. The sleeve is removed from the slots of the bracket tongues by sliding the sleeve and associated lip in an upward direction.

BRIEF DESCRIPTION OF THE DRAWINGS

FIG. 5 shows a front elevation view of an alternate embodiment of the invention.

FIG. 6 shows a side elevation view of the embodiment of FIG. 5.

FIG. 7 shows a front elevation view of an additional embodiment of the invention.

FIG. 8 shows a side elevation view of the embodiment of FIG. 7.

BEST MODE FOR CARRYING OUT THE INVENTION

Figure 1:
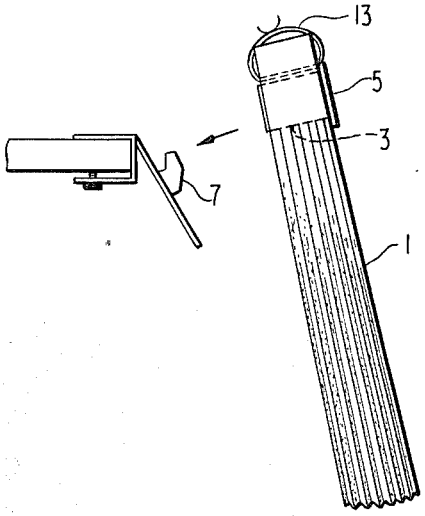
FIG. 1 illustrates a side elevation view of a disengaged support member and support sleeve in accordance with the invention.

The remaining portion of this specification will describe preferred embodiments of the invention when read in conjunction with the attached drawings, in which like reference characters identify identical apparatus.

FIG. 1 shows a side elevation view of an apparatus for supporting a plurality of stacked bags, for example plastic bags, and dispensing the bags in a manner to allow the bags to be easily filled. As shown in FIG. 1, a plurality of stacked plastic bags 1 having aligned apertures in their respective front and back walls are engaged with a sleeve 3 in a stacked relation when the sleeve is passed through the aligned apertures of the bags. The sleeve 3 has an outward flange 5 that contacts the front wall of the topmost bag of the stacked bags 1 when the bags are engaged with the sleeve 3.

Figure 2:
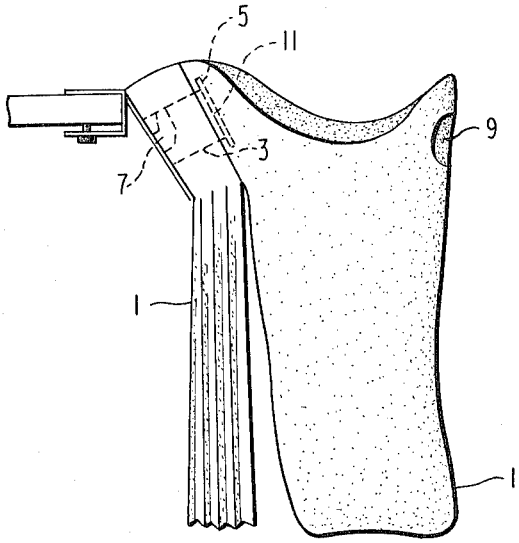
FIG. 2 illustrates a side elevation view of an engaged support member and support sleeve and an associated open bag in accordance with the invention.

In accordance with the invention, the sleeve 3 is engaged with a corresponding support member 7 to support the bags 1 in a stacked relation. As shown in FIG. 2, when the sleeve 3 and associated stacked bags 1 are engaged with the support member 7, the stacked bags may then be successively loaded with material, for example groceries or the like and disengaged from the outward flange 5 of the sleeve 3.

More particularly, as is known in the art, a front aperture 9 of each of the stacked bags 1 is sufficiently large to enable the front wall of each bag to be easily pulled out of engagement with the outward flange 5 of the sleeve 3. A corresponding aligned back aperture 11 of each bag has dimensions slightly smaller than the front aperture 9 and, therefore, the back aperture is maintained in engagement with the outward flange 5 even though the corresponding front aperture 9 has been pulled out of engagement with the outward flange 5.

Thus, the extended topmost bag may be easily loaded with groceries or other articles and, after the bag is loaded, the bag may be pulled to distend the rear aperture 11 and to thereby disengage the rear wall from the outward flange 5. Thereafter, the front wall of the next bag may be pulled out of engagement with the outward flange 5 and the loading process may be repeated.

It should be appreciated that the apparatus of the invention provides a simple and effective means to hold the flexible walls of a plastic bag in an open position to allow easy loading. In addition, after the last bag in a stack has been loaded and removed, the sleeve 3 may be easily disengaged from the support member 7 to receive a new stack of bags. Thereafter, the sleeve is again snapped into an engaged relation with the support member and successive stacked bags in the new stack are removed in the above-described manner.

The sleeve 3 and outward flange 5 may be constructed of a flexible material such as plastic to allow the sleeve to be easily engaged and disengaged from the support member 7. Such a plastic sleeve is relatively inexpensive and, therefore, a separate sleeve may be supplied in engaged relation with each stack of plastic bags. Thus, after a stack of bags is used, the associated empty sleeve is removed and discarded and the next stack of bags with its associated engaged plastic sleeve is snapped onto the support member 7. However, as indicated above, in order to minimize cost, a single plastic sleeve may be repeatedly used to support and dispense stacks of bags.

In order to facilitate the storage of stacks of bags and to ensure that bags do not slip from the back end of the sleeve 3 before the sleeve is engaged with the support member 7, a stack retention aid 13, for example a string or a wire may be passed through the aligned apertures of the bags and tied or otherwise secured to hold the bags in a stack so that the sleeve 3 may be easily and quickly snapped to the support member 7 without losing bags. Thereafter, the alignment aid 13 is removed and the bags are loaded and removed in the above-described manner.

Figure 3:
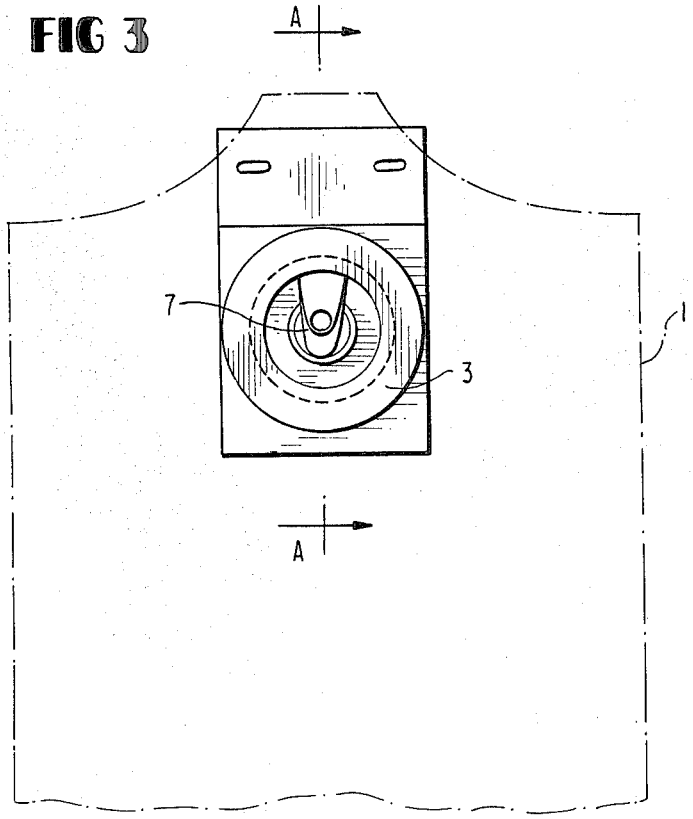
FIG. 3 illustrates a front elevation view of the engaged support member and sleeve of FIGS. 1 and 2.
Figure 4:
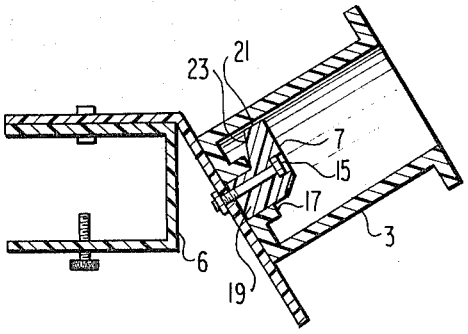
FIG. 4 illustrates a sectional view of the support member and sleeve of FIG. 3 taken along the line A—A in the direction of the arrow.

FIG. 3 shows a front elevation view of the support member 7 and sleeve 3 in an engaged relation with a stack of plastic bags 1. FIG. 4 illustrates a sectional view of the engaged support member and sleeve 3 taken along a line A—A, in the direction of the arrows. As shown in FIG. 4, the support member 7 is affixed to an inclined surface of a front plate of a support bracket 6 by a bolt 15. The flexible plastic sleeve 3 has an inner collar 17 that has approximately the same dimensions as a shaft portion 19 of the support member 7.

The flexible plastic sleeve 3 is snapped into engagement with the support member 7 by sliding a radially extending edge 21 of the support member through the opening of the inner collar 17 and pressing the sleeve 3 downwardly until the walls of the inner collar 17 are engaged with the shaft portion 19 and the extending edge 21 is engaged with a side wall of the sleeve 3.

Thus, when a stack of bags 1 is engaged with the sleeve 3, an outward pulling force may be applied to disengage the bags from the outward flange 5 without disengaging the sleeve 3 from the support member 7, since a portion of the inner collar 17 is held in contact with a surface 23 of the support member 7 and a portion of the inner wall of the sleeve 3 is held in contact with the extending top edge 21 of the support member to resist outward movement of the sleeve 3. The sleeve 3 is disengaged from the support member 7 by applying an outward and upward force on the sleeve to flex the sleeve upwardly and to thereby cause a lower portion of the inner collar 17 to slide out of engagement with a corresponding surface of the shaft portion 19.

FIGS. 5 and 6 illustrate an embodiment of the invention for retaining an end of a sleeve 25 having an associated outward flange 27. It should be appreciated that the sleeve 25 and outward flange 27 are used in the above-described manner to support and dispense a stack of bags.

As shown in FIGS. 5 and 6, the sleeve 25 has a lip 29 that is formed at the rear of the sleeve 25. The lip 29 may be slid into and out of engagement with a corresponding U-shaped slot formed by an extending edge 31 of a U-bracket 37. The U-bracket 37 is affixed to a support plate 33 that may include a mounting bracket (not shown). It should be understood that the U-bracket 37 may be affixed to the support plate 33 by any means known to the art, for example an outer edge 39 of the U-bracket 37 may be screwed or bolted to the support plate 33.

If the lip 29 of the sleeve 25 is at least as large as the outward flange 27, a stack of bags will preferably be supplied for use already mounted on an associated sleeve 25. Also, a stack retention aid for the bags is not necessary since the lip 29 will serve to maintain the stacked bags in an engaged relation with the sleeve 25 even if the sleeve is not engaged with the slot formed by the extending edge 31 of the U-bracket 37.

However, if the dimensions of the lip 29 are sufficiently small with respect to the dimensions of the smallest aperture of the stacked bags, a single sleeve 25 may be repeatedly used to engage and dispense many stacks of bags, since each new stack of bags may be readily slipped onto the sleeve 25.

FIGS. 7 and 8 show an additional embodiment of the invention for supporting a corresponding sleeve 41 having an outward flange and an inwardly facing lip 45 as described for the embodiment of FIGS. 5 and 6. As shown in FIGS. 7 and 8, bracket tongues 43 are used to retain the inwardly facing lip 45 of the sleeve 41. Each of the bracket tongues 43 may be fixed to a support plate 33 in the manner described for the U-bracket 37 of FIGS. 5 and 6.

It should be understood that the invention may be embodiment in other specific forms without departing from its spirit or essential characteristics. For example, other support means may be used to detachably support a sleeve for dispensing bags and still remain within the spirit of the invention. The present embodiments are, therefore, to be considered in all respects as illustrative and not restrictive, the scope of the invention being indicated by the claims rather than by the foregoing description, and all changes which come within the meaning and range of the equivalents of the claims are therefore intended to be embraced therein.

What is claimed is:

1. Apparatus for supporting a stack of bags and maintaining a forwardmost bag in said stack in a loading position, each bag in said stack having an enlarged aperture in the top portion of its forwardmost wall and an aligned smaller aperture in the top portion of its corresponding rear wall, the apparatus comprising:

sleeve means passing through the aligned apertures in said stack of bags to support said bags, said sleeve means including flange means positioned at the forward end of said sleeve, said flange means dimensioned to readily pass through the enlarged aperture of the front wall and to resist passing through the smaller aperture to retain the rear wall when the front wall is pulled forward to define said loading position, and collar means positioned at the back end of said sleeve for defining a sleeve support surface extending axially and inwardly within said sleeve; and support means mounted for detachably engaging at least a portion of said sleeve support surface of said collar means to support said sleeve in a bag dispensing position, said support means including an axially extending shaft portion for contacting said support surface and a radially outwardly extending edge portion for contacting an inner wall of said sleeve to support said sleeve in the bag dispensing position when the sleeve is pressed into engagement with said support means.

2. The apparatus of claim 1 wherein said collar means is shaped to define a cylindrical sleeve support surface.

* * * * *